US006994622B2

(12) United States Patent
Koessler

(10) Patent No.: US 6,994,622 B2
(45) Date of Patent: Feb. 7, 2006

(54) VENT APPARATUS

(76) Inventor: Juergen Koessler, 902-1736 West 10th Avenue, Vancouver, BC (CA) V6J 2A6

( * ) Notice: Subject to any disclaimer, the term of this patent is extended or adjusted under 35 U.S.C. 154(b) by 0 days.

(21) Appl. No.: 10/743,819

(22) Filed: Dec. 24, 2003

(65) Prior Publication Data

US 2005/0148295 A1 Jul. 7, 2005

(51) Int. Cl.
*F24F 13/20* (2006.01)

(52) U.S. Cl. ..... 454/367; 52/198

(58) Field of Classification Search ..... 454/367, 454/359, 358, 275, 366
See application file for complete search history.

(56) References Cited

U.S. PATENT DOCUMENTS

| | | | | | |
|---|---|---|---|---|---|
| 2,565,131 | A | * | 8/1951 | Johnson | 454/366 |
| 2,628,551 | A | * | 2/1953 | Leigh | 454/366 |
| 2,636,429 | A | * | 4/1953 | Parsons | 454/366 |
| 2,741,972 | A | * | 4/1956 | Pryne | 454/27 |
| 2,770,833 | A | | 11/1956 | Drechsel | |
| 3,285,155 | A | * | 11/1966 | Maltenfort | 454/359 |
| 3,788,207 | A | | 1/1974 | Doherty, II | |
| 4,022,117 | A | * | 5/1977 | Mallian | 454/359 |
| 4,151,789 | A | * | 5/1979 | Grobard | 454/359 |
| 4,214,511 | A | * | 7/1980 | Mueller | 454/182 |
| 4,297,818 | A | | 11/1981 | Anderson | |
| 4,480,534 | A | * | 11/1984 | Sloan | 454/182 |
| 4,625,630 | A | * | 12/1986 | Carroll et al. | 454/182 |
| 4,940,042 | A | | 7/1990 | Moore, Jr. et al. | |
| 4,947,596 | A | | 8/1990 | Kight | |
| 5,062,354 | A | | 11/1991 | Goins et al. | |
| 5,129,387 | A | * | 7/1992 | Behrens | 126/570 |
| 5,344,363 | A | * | 9/1994 | Pollock | 454/182 |
| 5,591,080 | A | | 1/1997 | Ward | |
| 5,632,678 | A | * | 5/1997 | Doelfel | 454/366 |
| 5,662,522 | A | * | 9/1997 | Waltz | 454/359 |
| 5,722,181 | A | * | 3/1998 | Meyer | 34/235 |
| 5,916,023 | A | * | 6/1999 | Meyer | 454/359 |
| 6,293,862 | B1 | * | 9/2001 | Jafine et al. | 454/359 |
| 6,299,529 | B1 | * | 10/2001 | Preston | 454/367 |
| 6,302,788 | B1 | * | 10/2001 | Gagnon | 454/367 |

FOREIGN PATENT DOCUMENTS

| | | |
|---|---|---|
| CA | 1288856 | 9/1989 |
| CA | 2062907 | 10/1998 |
| CA | 2357531 | 9/2003 |

* cited by examiner

*Primary Examiner*—Derek S. Boles
(74) *Attorney, Agent, or Firm*—Oyen Wiggs Green & Mutala LLP

(57) ABSTRACT

A vent provides a route for gas flow through a building envelope. The vent comprises a substantially hollow cover member having a cover member surface which defines a vent passageway. The vent may comprise a substantially hollow adapter member. The adapter member is coupleable to the cover member at its exterior end and to a conduit at its interior end to provide fluid communication between the vent passageway and the conduit. The vent may comprise a screen which extends across the vent passageway. The screen has a deformable bend and a plurality of surfaces which secure the screen to the cover member without using separate fasteners. The vent may comprise a damper member with an exterior surface having a profile that conforms to the contour of a portion of the cover member surface.

37 Claims, 11 Drawing Sheets

VENT APPARATUS

TECHNICAL FIELD

The invention pertains to vents. Particular embodiments of the invention relate to vents used in buildings.

BACKGROUND

Many buildings have vents which provide routes for exchange, ventilation, circulation and/or movement of gas through the building envelope. Such gases may comprise air or water vapour, for example. Buildings may have ventilation systems, which take in "fresh" air from outside of the building and expel "stale" air from inside the building. Fresh air may be taken into a building or stale air may be expelled from a building through one or more vents. Some buildings incorporate other systems and/or apparatus, such as air conditioning systems, range hoods and forced air clothes dryers, which require gas flow between the inside and outside of a building.

Typically, a vent is associated with a conduit which conveys gas towards or away from the vent. A vent typically comprises a vent passageway in fluid communication with the associated conduit to provide a means for gas flow through the building envelope. Vents may provide a number of additional functions. For example, vents may comprise weatherproofing features to minimize the amount of moisture leakage into the building or the building layers. Vents may also provide a more aesthetically pleasing terminus for their associated conduits.

There are many vent designs known in the art. For example:

- Canadian patent No. 2,062,907 (Sirjoo) discloses a vent incorporating an adjustable screw cap vent cover which extends outwardly from the external wall of a building and which is adjustable to permit air flow through the vent when the cap is open and to prevent air flow through the vent when the cap is closed; and
- Canadian patent No. 2,357,531 (Myint) shows a security air vent which allows for the flow of air, but which comprises a screen having S-shaped structural members for preventing the back flow of solids or liquids into the associated building aperture.

Some vents comprise vent covers which extend outwardly from the exterior surface of the building. Such vent covers may provide weatherproofing for the vent and may also provide desirable aesthetics. Vents and vent covers may be formed in a single unitary construction.

Vents are preferably sized and shaped such that they are easily mounted to the building structure and easily coupled to their associated conduits. Typically, a vent comprises a flange or the like, which is sized and shaped to engage its associated conduit. Where vents and vent covers are made from a single unitary construction, a separate vent and vent cover combination is required for each size and shape of conduit.

Vents may incorporate dampers to control the flow of gases and/or other materials through the vent. Typically, a damper is formed from a flat (i.e. planar) piece of material that is hingeably mounted to permit flow of gas through the vent in a desired direction and to restrict flow of gas through the vent in the opposing direction. Some dampers undesirably restrict the flow of gas in the desired direction.

Some vents (or vent covers) comprise screens. Typically, such screens are integrally formed with the vent or are attached to the vent using fasteners, such as staples, screws, rivets or the like. Screens help to prevent debris from accumulating in the vent and from potentially entering into the building interior. As screens are typically located near the outermost ends of vents, there is a considerable likelihood for a screen to be damaged or to weaken over time because of exposure to the elements. Replacement of a screen that is integrally formed with a vent component requires replacing the entire vent component and may require removal of outer building layers. Replacement of a screen that is attached to a vent component using fasteners requires removing and replacing the fasteners which can damage the body of the vent component.

There is a general desire to provide vents which ameliorate at least some of the aforementioned or other disadvantages of existing vents.

SUMMARY OF THE INVENTION

A first aspect of the invention provides a vent which comprises a substantially hollow cover member and a screen. The cover member has a cover member surface which defines a vent passageway and which comprises a protrusion. The protrusion projects into the vent passageway. The screen comprises a plurality of screen apertures and a first bend for receiving the protrusion. The first bend in the screen is resiliently deformable to exert pressure on the protrusion and to secure the screen to the cover member such that the screen spans the vent passageway.

The screen may comprise a first surface, which extends from the first bend along a first side of the protrusion, and a second surface, which extends from the first bend along a second side of the protrusion. The first and second surfaces may exert pressure on the protrusion.

The screen may comprise a third surface, which extends from the second surface across the vent passageway to a first portion of the cover member surface on an opposing side of the vent passageway from the protrusion. The screen may also comprise a fourth surface, which extends from the third surface along the first portion of the cover member surface.

The fourth surface may receive one or more projections which extend from the first portion of the cover member surface and project through one or more corresponding screen apertures. One or more fastener members may also be provided. Each fastener member may be coupleable to a corresponding one of the one or more projections for retaining the fourth surface against the first portion of the cover member surface.

Prior to deformation, the third surface of the screen may be substantially planar or may comprises at least one curve.

The vent may comprises a a Z-shaped bend on one end thereof. The Z-shaped bend may include the first bend.

The vent may comprise a damper member located in the vent passageway and pivotally coupled to the cover member. An exterior surface of the damper member may have a profile that is substantially similar to a contour of a second portion of the cover member surface. The profile of the exterior surface of the damper member and the contour of the second portion of the cover member surface may be curved or may comprise a similarly shaped bend.

The damper member may be pivotable between a closed configuration wherein a distal end of the damper member abuts against the protrusion and an open-most configuration wherein the exterior surface of the damper member extends along the second portion of the cover member surface.

The vent may comprise a substantially hollow adapter member. The adapter member may be coupleable to the cover member at its exterior end and to a conduit at its interior end to provide fluid communication between the vent passageway and the conduit.

The cover member may comprise a pair of substantially parallel flanges which define a slot and the exterior end of the adapter member may comprise a vent flange which is insertable into the slot for coupling the exterior end of the adapter member to the cover member. When the vent flange is inserted in the slot, at least one of the substantially parallel flanges may be resiliently deformed so as to exert pressure on the vent flange.

Another aspect of the invention provides a vent which comprises a substantially hollow cover member and a damper member. The cover member comprises a cover member surface which defines a vent passageway. A first portion of the cover member surface has a curved contour. The damper member is located in the vent passageway and is pivotally coupled to the cover member. An exterior surface of the damper member has a curved profile that is substantially similar to the curved contour of the first portion of the cover member surface.

Another aspect of the invention provides a vent which comprises a substantially hollow cover member and a damper member. The cover member comprises a a cover member surface which defines a vent passageway. A first portion of the cover member surface has a first bend in its contour. The damper member is located in the vent passageway and is pivotally coupled to the cover member. An exterior surface of the damper member has a second bend, which has a profile that is substantially similar to a contour of the first bend.

Further aspects of the invention, features of specific embodiments of the invention and applications of the invention are described below.

BRIEF DESCRIPTION OF THE DRAWINGS

In drawings which depict non-limiting embodiments of the invention.

DETAILED DESCRIPTION

Throughout the following description, specific details are set forth in order to provide a more thorough understanding of the invention. However, the invention may be practised without these particulars. In other instances, well known elements have not been shown or described in detail to avoid unnecessarily obscuring the invention. Accordingly, the specification and drawings are to be regarded in an illustrative, rather than a restrictive, sense.

The invention disclosed herein relates to vents which provide a route for the exchange of air or other gases through a building envelope. Typically, a vent is mounted to provide a passageway through the building envelope (i.e. the walls or roof). The interior end of the vent may be coupled to a conduit, which may generally comprise any aperture, duct, passageway, flume, spout, hose, tube, pipe, channel or the like. Typical examples of conduits include, but are not limited to, air ducts for moving air within a building's heating, cooling or ventilation systems and exhaust hoses from forced-air clothes dryers and/or air conditioning systems.

Vents according to preferred embodiments of the invention comprise a substantially hollow cover member having a cover member surface which defines a vent passageway. A vent may also comprise a substantially hollow adapter member. The exterior end of the adapter member is coupleable to the cover member and the interior end of the adapter member is coupleable to a conduit to provide fluid communication between the vent passageway and the conduit. The vent may comprise a screen which spans the vent passageway. The screen preferably has a plurality of resiliently deformable surfaces and/or bends, which secure the screen to the cover member without using separate fasteners. The screen may have a Z-shaped bend at one end thereof. The vent may also comprise a damper member which is hingeably coupled to the cover member surface. The exterior surface of the damper member may have a profile that is similar to the contour of a portion of the cover member surface. The damper is pivotable between a closed configuration and an open-most configuration, where the exterior surface of the damper member extends along the portion of cover member surface.

Figure 1:
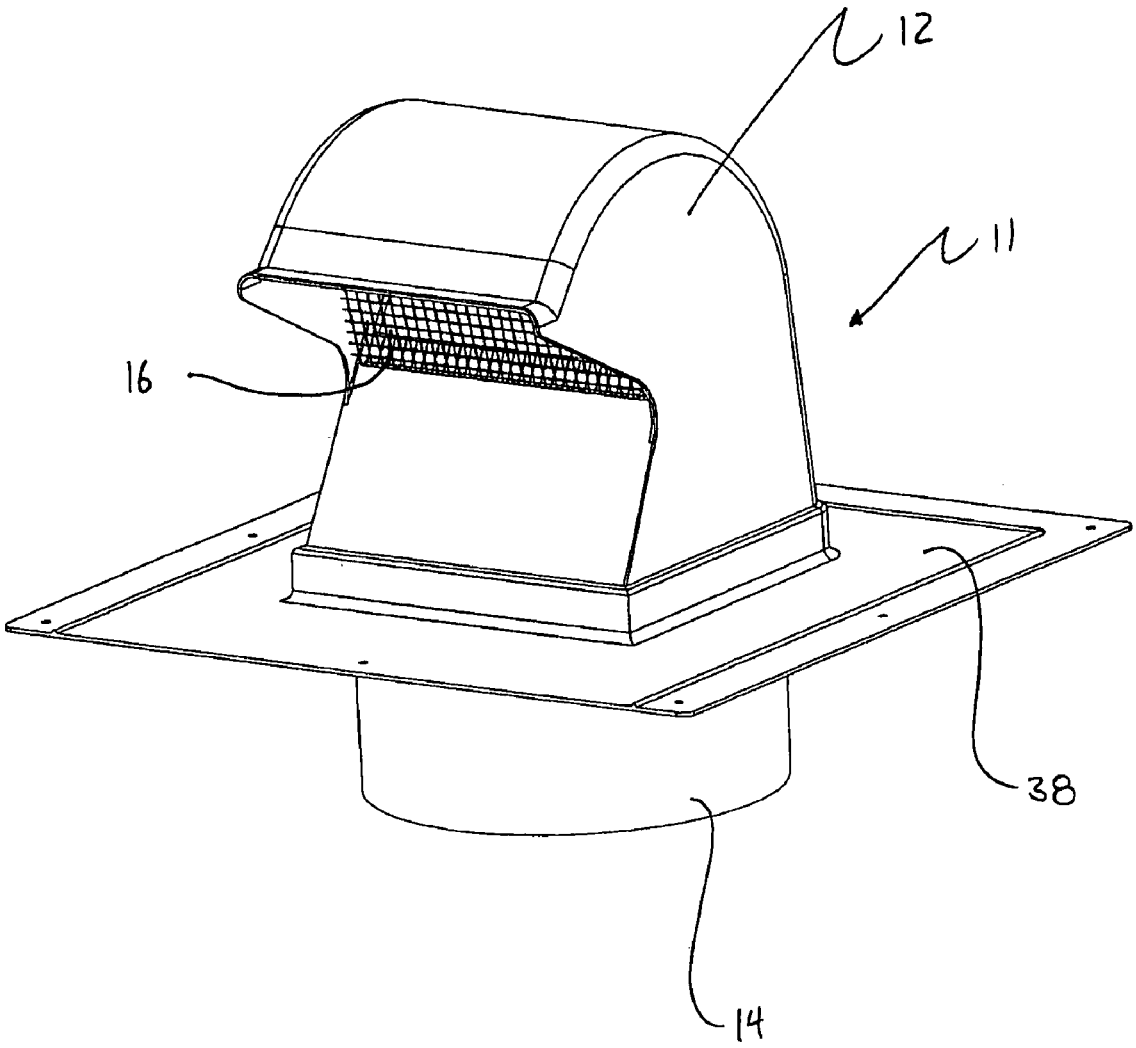
FIG. 1 is an isometric view of a vent according to a particular embodiment of the invention.
Figure 2:
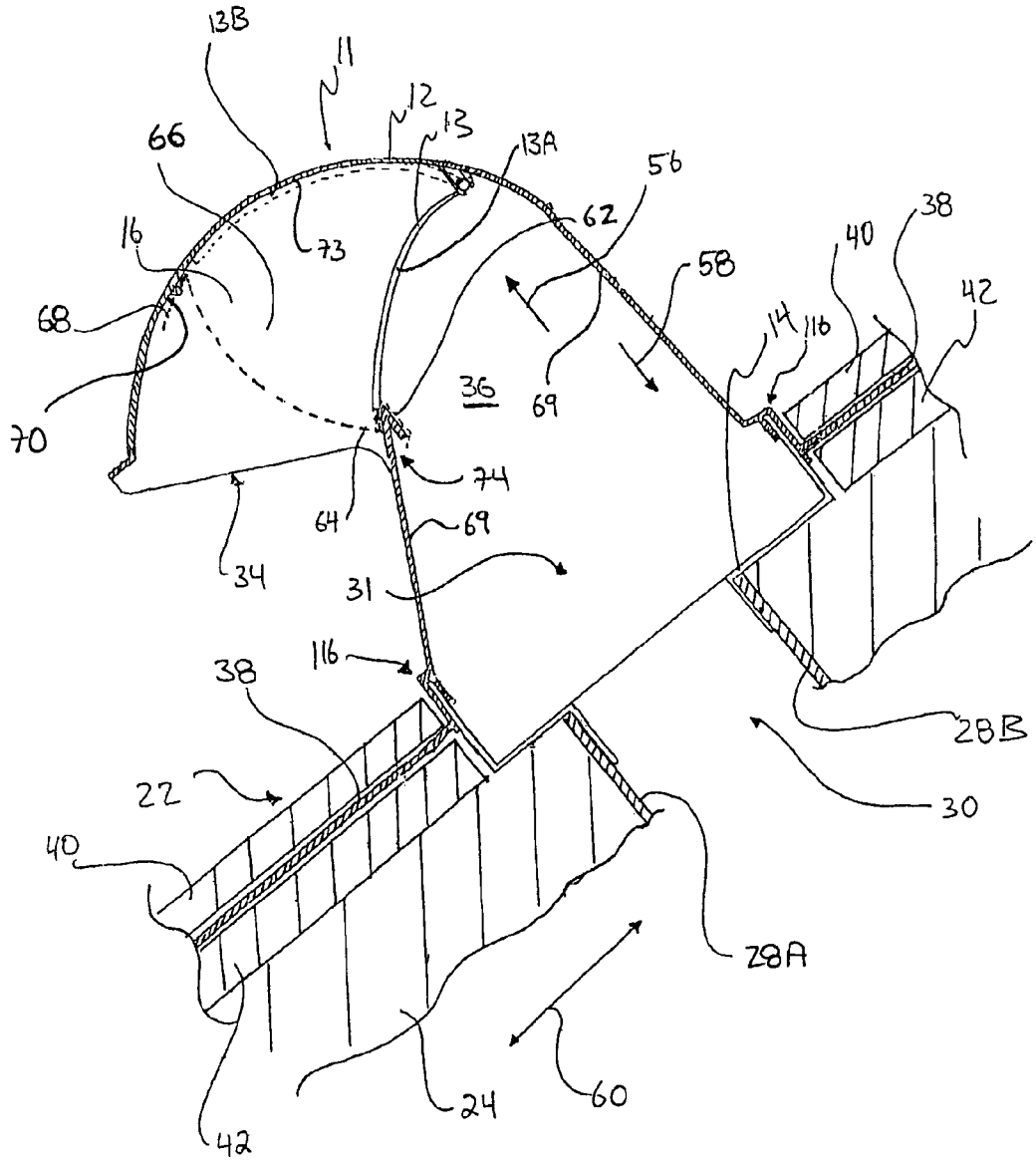
FIG. 2 is a cross-sectional view of the FIG. 1 vent installed in the pitched roof of a building.

FIGS. 1 and 2 depict a vent 11 according to a particular embodiment of the invention. As shown most effectively in the cross-sectional view of FIG. 2, vent 11 comprises: a cover member 12, a damper member 13, an adapter member 14 and a screen 16. Preferably, cover member 12, damper member 13 and adapter member 14 are made of plastic. Screen 16 may be metallic or plastic. Those skilled in the art will appreciate that in alternative embodiments, vent 11 and any of its components may be constructed from a wide variety of suitable materials.

FIG. 2 depicts vent 11 installed in the roof 22 of a building 24. In the illustrated embodiment, roof 22 is pitched at an angle. Vents embodying the inventive concepts of the present invention may generally be installed in any building surface. For example, vent 11 may also be installed in a roof having a substantially horizontal orientation or a wall having a substantially vertical orientation. Building 24 has a conduit 30 defined by the walls 28A, 28B. Cover member 12 comprises a substantially hollow body having a cover member surface 69 which defines a vent passageway 36. As shown in FIG. 2, vent passageway 36 extends from an interior end 31 to an exterior end 34 of cover member 12.

This description and the accompanying claims use a number of directional conventions to clarify their meaning:

(i) "outward", "outwardly", "outwardmost", "exterior" and similar words are used to refer to directions that are generally oriented from an interior end 31, toward an exterior end 34 of vent passageway 36 or from an interior toward an exterior of building 22 (see for example arrow 56 of FIG. 2);

(ii) "inward", "inwardly", "inwardmost", "interior" and similar words are used to refer to directions that are generally oriented from an exterior end 34, toward an interior end 31 of vent passageway 36 or from an exterior toward an interior of building 22 (see for example arrow 58 of FIG. 2); and (iii) "transverse", "transversely", "side", "sideways" and similar words refer to any direction that extends along the building surface in which vent 11 is mounted. In the illustrated embodiment of FIG. 2, vent 11 is mounted in pitched roof 22 and double headed arrow 60 indicates two examples of transverse directions.

Those skilled in the art will appreciate that directional definitions used in this description and the accompanying claims depend on the specific orientation of vent 11 and the building surface in which vent 11 is mounted. Accordingly, these directional terms are not strictly defined and should not be interpreted narrowly.

FIG. 2 depicts vent 11 installed in pitched roof 22. As shown in FIGS. 1 and 2, cover member 12 comprises a mounting flange 38 which extends transversely from an interior end of cover member 12. In the illustrated embodiment, mounting flange 38 extends between exterior roof layer 40 and interior roof layer 42. Preferably, cover member 12 is installed when roof 22 is being built, such that mounting flange 38 may be installed in roof 22 after the application of interior roof layer 42, but prior to the application of exterior roof layer 40. Mounting flange 38 may be attached to interior roof layer 42 using an adhesive and/or fasteners (not shown). Suitable fasteners may include nails, screws, staples or the like. In alternative embodiments, mounting flange 38 may be attached to the exterior or interior surface of roof layer 40 and/or roof layer 42 during or after fabrication of roof 22.

Figure 3A:
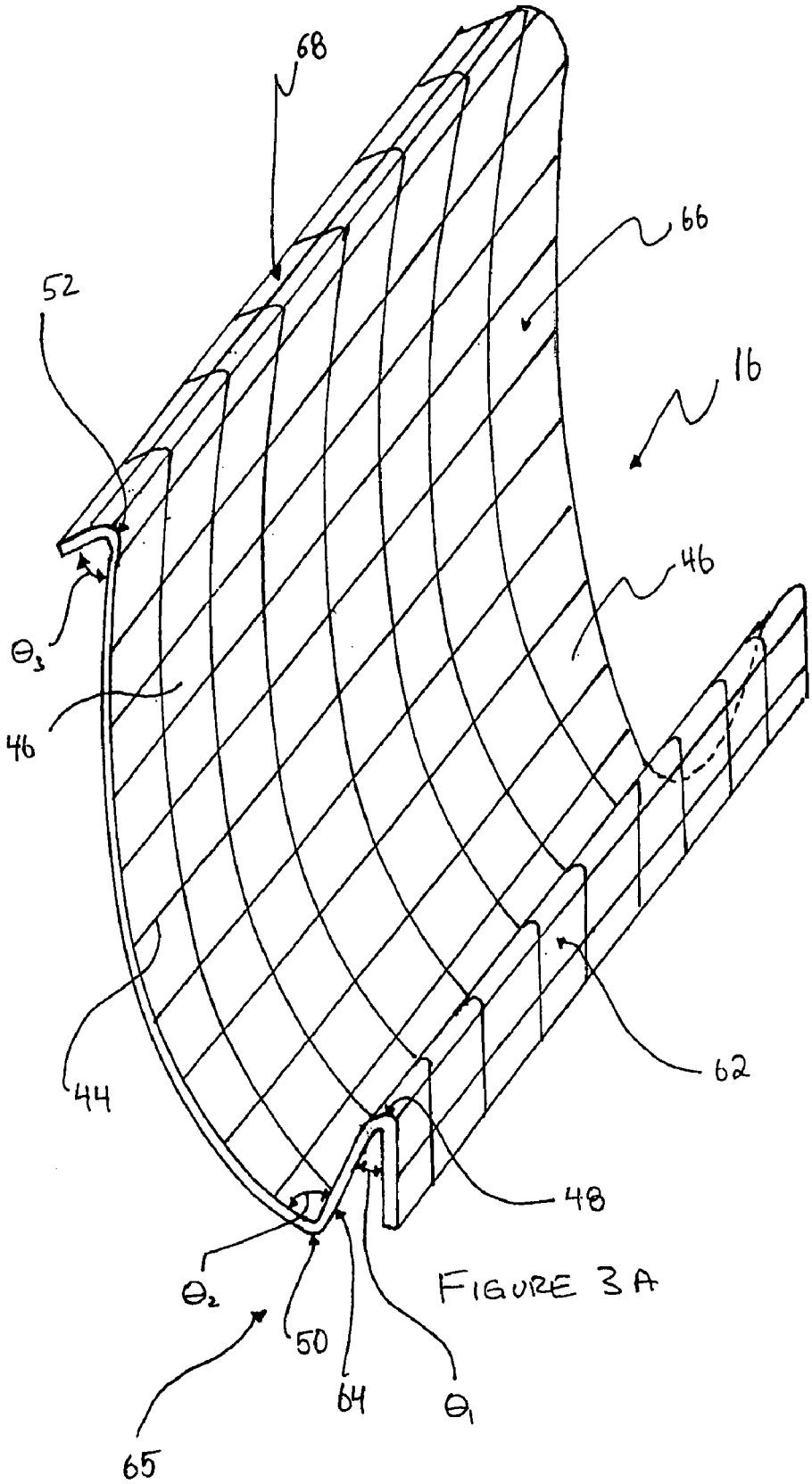
FIG. 3A is an isometric view of the screen of the FIG. 1 vent.

Vent 11 may comprise a screen 16. FIG. 3A shows a screen 16 according to a particular embodiment of the invention. As shown in FIG. 3A, screen 16 preferably comprises a grid 44 of material which defines a plurality of rectangular screen apertures 46. In alternative embodiments, screen 16 may comprise screen apertures 46 with different shapes. Screen apertures 46 have a smaller cross-sectional area than vent passageway 36 and conduit 30. Preferably, the material from which screen 16 is formed is resilient and deformable, such that screen 16 may be deformed for installation or removal as discussed below. Screen 16 comprises a number of surfaces 62, 64, 66, 68 which are respectively connected by bends 48, 50 and 52. For ease of explanation, surfaces 62, 64, 66, 68 are referred to herein as: first surface 62, second surface 64, third surface 66 and fourth surface 68; and bends 48, 50, 52 are referred to as: first bend 48, second bend 50 and third bend 52. Preferably, first, second and fourth surfaces 62, 64, 68 are substantially planar when screen 16 is in its nominal (i.e. non-deformed) state.

Third surface 66 forms the main part of screen 16 and has an area that is preferably 5–25 times larger than the first, second and fourth surfaces 62, 64, 68. When screen 16 is installed in cover member 12, third surface 64 spans vent passageway 36 to help prevent debris from intruding through vent passageway 36 and into building 24.

One end of screen 16 comprises a "Z-shaped bend" 65, which comprises first bend 48 (between first surface 62 and second surface 64) and second bend 50 (between second surface 64 and third surface 66). Typically, first bend 48 will have an interior angle $\Theta_1$ in a range of 10–60° in its nominal state. In preferred embodiments, the nominal state of interior angle $\Theta_1$ may be in a range of 15–45°. Typically, second bend 50 will have an interior angle $\Theta_2$ in a range of 10–120° in its nominal state. In preferred embodiments, the nominal state of interior angle $\Theta_2$ may be in a range of 30–90°. Screen 16 also comprises a third bend 52 between third surface 66 and fourth surface 68. Third bend 52 typically has an interior angle $\Theta_3$ in the range of 30–120° in its nominal state. In preferred embodiments, the nominal state of interior angle $\Theta_3$ may be in a range of 45–90°. As explained in more detail below, bends 48, 50, 52 and surfaces 62, 64, 66, 68 permit screen 16 to be mounted to cover member 12 without using separate fasteners.

FIGS. 2, 3A, 4A and 4B depict how screen 16 may be removably mounted to cover member 12 without using separate fasteners. When installed, screen 16 spans vent passageway 36.

Figure 3B:
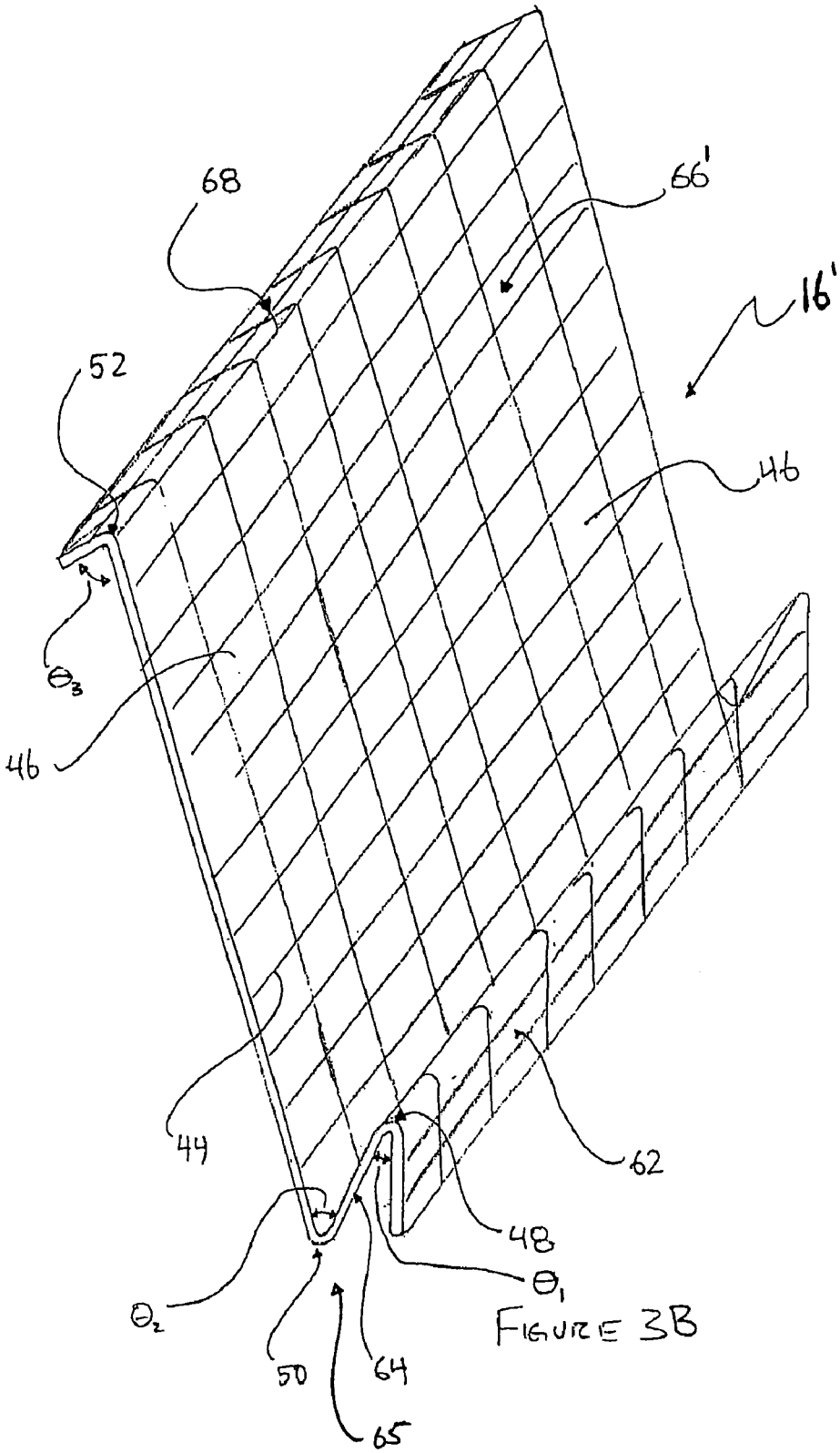
FIG. 3B is an isometric view of a vent screen according to an alternative embodiment of the invention.
Figure 4A:
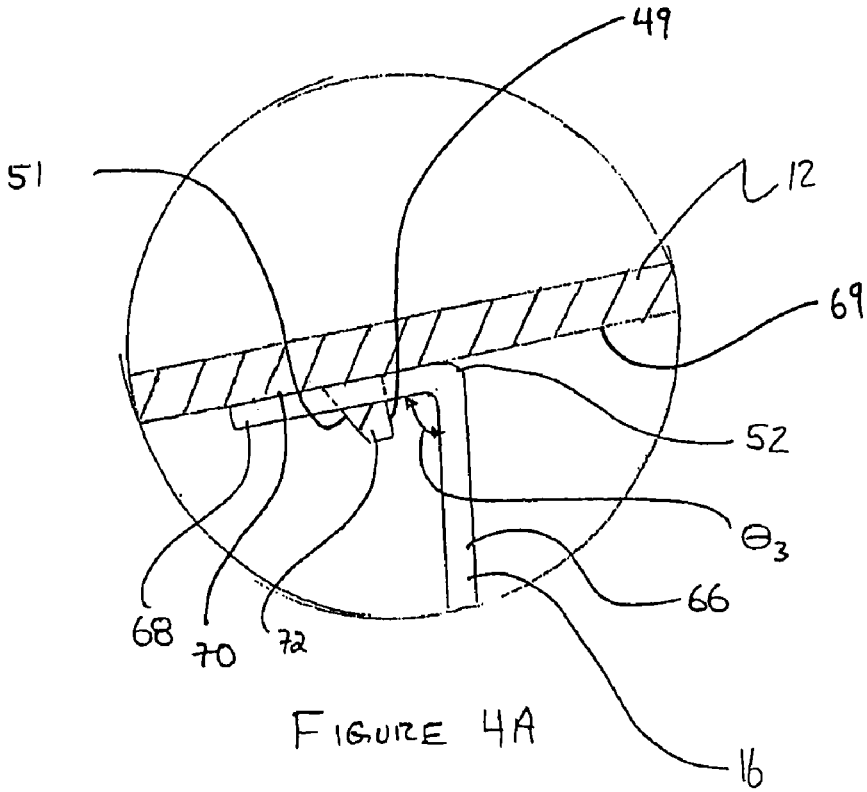
FIGS. 4A and 4B are partial cross sectional views depicting the mounting of the screen to the cover member of the FIG. 1 vent.
Figure 4B:
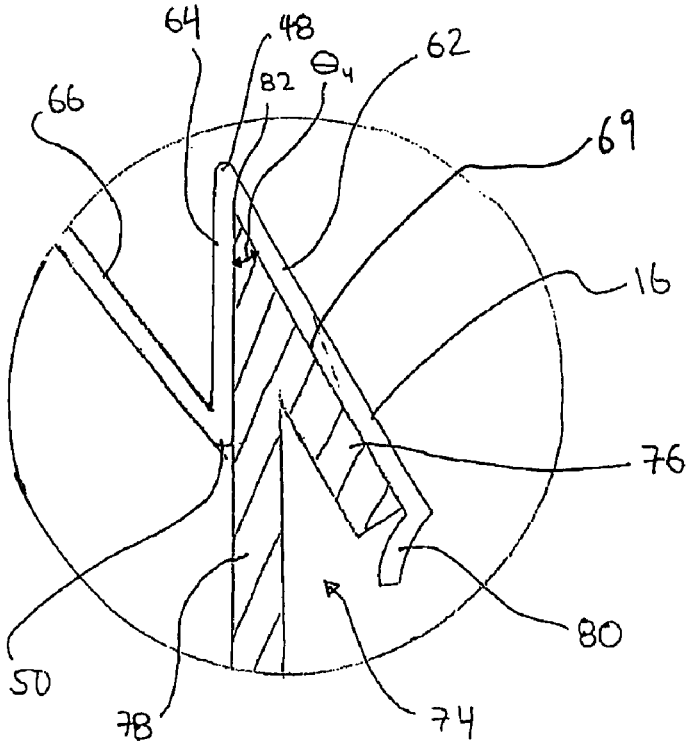

Referring to FIGS. 2 and 4B, cover member surface 69 comprises a protrusion 74 which projects into vent passageway 36. Protrusion 74 comprises a pair of sides 76, 78 which meet at apex 82. Although depicted as a sharp point, the intersection of sides 76, 78 at apex 82 may be rounded. As shown best in FIG. 4B, screen 16 is installed such that first bend 48 receives protrusion 74 with apex 82 extending into an interior of first bend 48. At least a portion of first surface 62 extends along side 76 and at least a portion of second surface 64 extends along side 78. Preferably, the angle $\Theta_4$ between sides 76, 78 of protrusion 74 is slightly larger than the nominal state of the interior angle $\Theta_1$ of first bend 48 (see FIG. 3). In this manner, when screen 16 is installed, first bend 48 is deformed, such that first and second surfaces 62, 64 tend to exert pressure against sides 76, 78 of protrusion 74. The pressure exerted by first and second surfaces 62, 64 on protrusion 74 helps to secure screen 16 to cover member 12. Optionally, as shown in FIG. 4B, a user may crimp (i.e. permanently deform) an overhanging distal end portion 80 of first surface 62. Crimping distal end portion 80 provides an additional means for securing screen 16 to protrusion 74.

Referring to FIGS. 2 and 4A, cover member surface 69 comprises a portion 70 on an opposite side of vent passageway 36 from protrusion 74. Screen 16 is installed such that fourth surface 68 extends along portion 70 of cover member surface 69. A shown best in FIG. 4B, portion 70 comprises a projection 72 which extends through a screen aperture 46 in fourth surface 68. Preferably, when installed, fourth surface 68 is slightly compressed towards third surface 66 (i.e. angle $\Theta_3$ of third bend 52 is compressed). This compression of screen 16 causes fourth surface 68 to apply resilient pressure against portion 70 of cover member surface 69 and/or against projection 72. Although not shown in the illustrated views, cover member 12 preferably comprises a plurality of projections 72 which are located at spaced apart intervals across portion 70 of cover member surface 69. Each of the plurality of projections 72 extends from portion 70 and projects through a corresponding screen aperture 46 in fourth surface 68.

In the illustrated embodiment of FIG. 4A, projections 72 each have one surface 49 which is oriented at substantially right angles to portion 70 of cover member surface 69 and a second surface 51 which forms a non-orthogonal angle with portion 70 of cover member surface 69. This shape of projections 72 facilitates easy installation and removal of screen 16. In other embodiments, projections 72 may have other shapes. For example, projections 72 may be bent or hook-shaped to help retain screen 16 in place once installed, all of the surfaces of projections 72 that abut portion 70 may be oriented at substantially right angles to portion 70 or all of the surfaces of projection 70 that abut portion 70 may be oriented at non-orthogonal angles to portion 70.

Screen 16 may be mounted to cover member 12 by installing one end of screen 16 and deforming screen 16 so that the other end of screen 16 may be installed. For example, a person may install fourth surface 68 against portion 70 of cover member surface 69 with projections 72 extending through screen apertures 46 and then deform screen 16 until protrusion 74 is received in first bend 48. Alternatively, a person may install screen 16 by fitting first bend 48 over protrusion 74 and then deforming screen 16 until fourth surface 68 fits against portion 70 of cover member surface 69 with projections 72 extending through screen apertures 46. Removal of screen 16 from cover member 12 may involve a similar process of deforming screen 16, so that protrusion 74 may be removed from first bend 48 and projections 72 may be extracted from their respective screen apertures 46.

FIG. 3B depicts a screen 16' according to an alternative embodiment of the invention. In most respects, screen 16' is similar to screen 16 (FIG. 3A) and similar reference numbers are used to refer to similar features of screens 16 and 16'. Screen 16' differs from screen 16 in that third surface 66' of screen 16' is planar in its nominal state. When installed in cover member 12, screen 16' may be planar or may be deformed to be slightly curved. In other respects, screen 16' is similar to screen 16 described above.

Figure 4C:
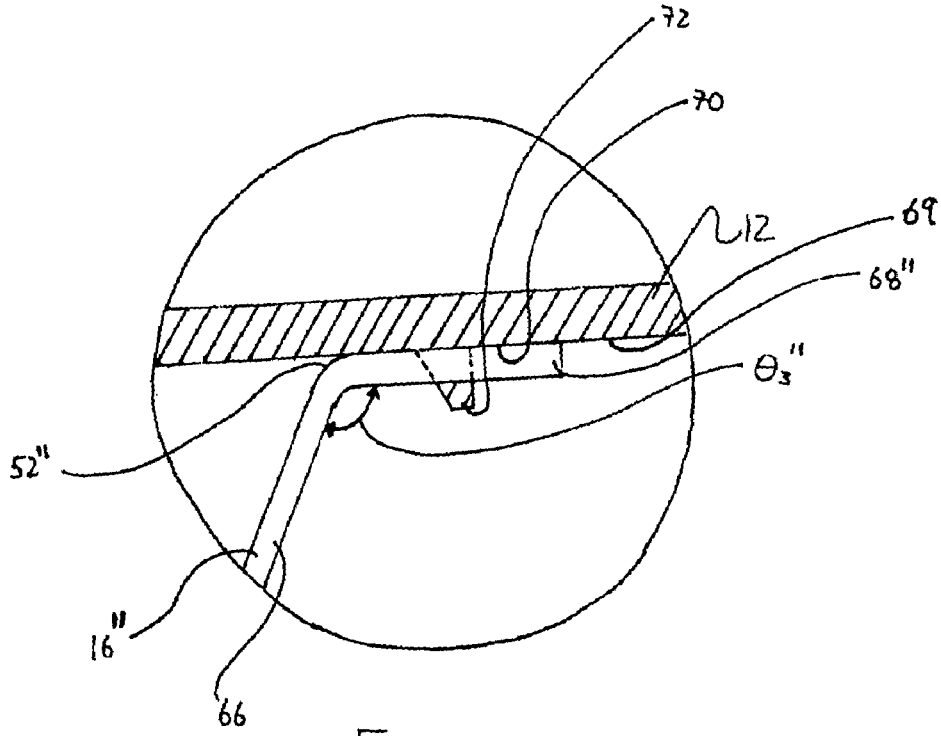
FIG. 4C is a partial cross-sectional view depicting the mounting of an alternative screen to the cover member of the FIG. 1 vent.

FIG. 4C depicts the mounting of a screen 16" to portion 70 of cover member surface 69 in accordance with an alternative embodiment of the invention. In most respects screen 16" is similar to screen 16 (FIG. 3A) and similar reference numbers are used to refer to similar features of screens 16 and 16". Screen 16" differs from screen 16, in that third bend 52" of screen 16" bends inwardly (i.e. in the opposite direction as third bend 52 of screen 16) and fourth screen surface 68" of screen 16" extends inwardly along portion 70 of cover member surface 69 (i.e. as opposed to fourth screen surface 68 of screen 16, which extends outwardly along portion 70 of cover member surface 69 (FIG. 4A)). Because of the direction of third bend 52", interior angle $\Theta_3$" of third bend 52" is on the interior side of screen 16" in contrast to angle $\Theta_3$ of third bend 52, which is on the exterior side of screen 16 (FIG. 4A). Interior angle $\Theta_3$" is typically in a range of 30–120° in its nominal state. In preferred embodiments, the nominal state of angle $\Theta_3$" may be in a range of 45–90°. In other respects screen 16" is similar to screen 16 described above.

Figure 4D:
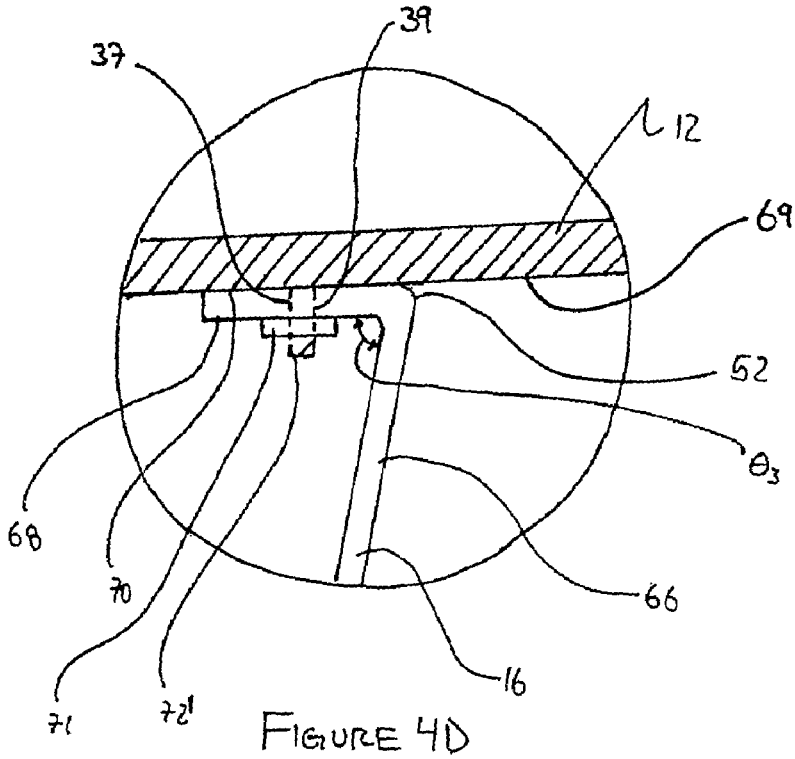
FIG. 4D is a partial cross-sectional view depicting an alternative mechanism for mounting the screen to the cover member of a vent according to an alternative embodiment of the invention.

FIG. 4D is a partial cross-sectional view depicting the mounting of a screen 16 to portion 70 of cover member surface 69 according to another alternative embodiment of the invention. Screen 16 of the FIG. 4D embodiment is the same as screen 16 in FIGS. 3A and 4A and similar reference numbers are used to refer to similar features. The embodiment of FIG. 4D differs from that of FIGS. 3A and 4A, in that projection 72' comprises generally parallel sidewalls 37, 39 and a fastener member 71 is provided to help couple screen 16 to cover member 12. In other embodiments (not shown), sidewalls 37, 39 need not be parallel and may approach one another as they extend from portion 70 of cover member surface 69. Preferably, projection 72' is integral with cover member 12 and portion 70 of cover member surface 69. In the illustrated embodiment, projection 72' extends generally orthogonally from portion 70 of cover member surface 69, but in other embodiments, projection 72' may extend from portion 70 at other angles. Projection 72' may also be round in cross-section (i.e. such that sidewalls 37, 39 are part of a single cylindrical surface).

In some embodiments, projection 72' may be threaded and fastener member 71 may comprises a nut or may otherwise be threaded, such that fastener member 71 may be screwed onto projection 72' to help retain fourth surface 68 of screen 16 against portion 70 of cover member surface 69. In other embodiments, fastener member 71 may comprise a deformable aperture (not shown), such that fastener member 71 may be pushed onto projection 72 to form a friction fit against sidewalls 37, 39 and to help retain fourth surface 68 of screen 16 against portion 70 of cover member surface 69. Sidewalls 37, 39 of projection 72' may comprise ribs (not shown) to enhance the strength of such a friction fit. In other respects, screen 16 and the mounting thereof is similar to screen 16 described above.

As shown in FIG. 2, vent 11 may comprise a damper member 13. Damper member 13 is shown in more detail in FIGS. 5A and 5B, which respectively depict cross-sectional and bottom views of damper member 13, and in FIG. 6, which shows a magnified partial cross-sectional view of vent 11 depicting damper member 13 in its closed configuration 13A and its open-most configuration 13B (shown in dashed lines). In the illustrated embodiment, damper member 13 comprises a body 92 that has a hinge end 96, a distal end 94 and an exterior surface 93 having a generally curved profile.

Hinge end 96 of damper member 13 is hingeably coupled to cover member 12. In the illustrated embodiment, damper member 13 is coupled to cover member 12 by a plurality of hinges 90. Each hinge 90 preferably comprises a cylindrical dowel 98 and an aperture 104. In the illustrated embodiment, each hinge 90 also comprises a pair of hinge guides 100. As shown best in FIG. 6, for each hinge 90, cover member 12 comprises a pair of dowel enclosure members 102A, 102B which project into vent passageway 36. In the illustrated embodiment, dowels 98 and dowel enclosure members 102A, 102B are shaped and/or sized such that dowels 98 may be removably inserted between dowel enclosure members 102A, 102B by deforming dowel enclosure members 102A, 102B (i.e. in a "snap-together" fit). Once inserted, dowels 98 are pivotally supported between dowel enclosure members 102A, 102B to hingeably couple damper member 13 to cover member 12. When damper member 13 is pivoted at hinges 90, dowel enclosure members 102A, 102B may project through apertures 104 in the body 92 of damper member 13. Hinges 90 may comprise guides 100 on either side of dowels 98 to help limit undesired translation of damper member 13 (FIG. 5B).

Hinges 90 permit damper member 13 to pivot through a range of angular positions between its closed configuration 13A and its open-most configuration 13B. When damper member 13 is in its closed configuration 13A, its distal end 94 abuts against protrusion 74 (or some other portion of cover member surface 69), such that gas or other material is largely prevented from flowing inwardly through vent passageway 36 (i.e. in the direction of arrow 108 (FIG. 6)). There may be a limited amount of inward gas flow through damper member 13 when damper member 13 is in its closed configuration 13B. When pressure or other conditions cause gas (or other material) to travel outwardly through vent passageway 36 (i.e. in the direction of arrow 106 (FIG. 6)), the flow of gas causes damper member 13 to pivot (at hinges 90) from its closed configuration 13A toward its open-most configuration 13B.

Gas may flow outwardly when damper member 13 is at any angular position between its closed configuration 13A and its open-most configuration 13B. Advantageously, however, the exterior surface 93 of damper member 13 has a generally curved profile, such that when damper member 13 is in its open-most configuration 13B, the exterior surface 93 of damper member 13 conforms substantially with the generally curved contour of a portion 73 of cover member surface 69. When damper member 13 is in its open-most configuration 13B, the conformance of the profile of exterior surface 93 and the contour of portion 73 of cover member surface 69 minimizes the intrusion of damper member 13 into vent passageway 36 and minimizes the corresponding impediment to the outward flow of gas caused by damper member 13. The conformance of the profile of exterior surface 93 and the contour of portion 73 of cover member surface 69 provides vent passageway 36 with a maximum cross-sectional area which permits a maximum outward flow of gas through vent passageway 36.

Those skilled in the art will appreciate that the invention may comprise a damper member 13 having a different exterior surface profile and a portion 73 of cover member surface 69 having a different contour (i.e. other than curved), provided that there is conformance between the profile of the exterior surface 93 of damper member 13 and the contour of portion 73 of cover member surface 69 to maximize the cross-sectional area of vent passageway 36 and the outward flow of gas through damper member 13 when damper member 13 is in its open-most configuration. For example, the exterior surface 93 of damper member 13 may comprise one or more bends to conform with a similarly bent contour of portion 73 of cover member surface 69.

Figure 5A:
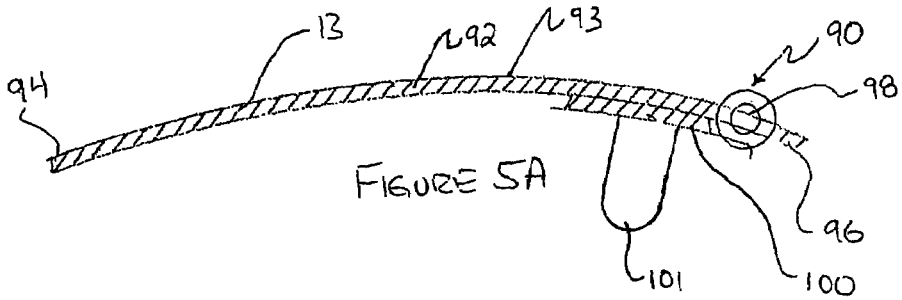
FIGS. 5A and 5B are respectively cross sectional and bottom views of the damper member of the FIG. 1 vent.
Figure 5B:
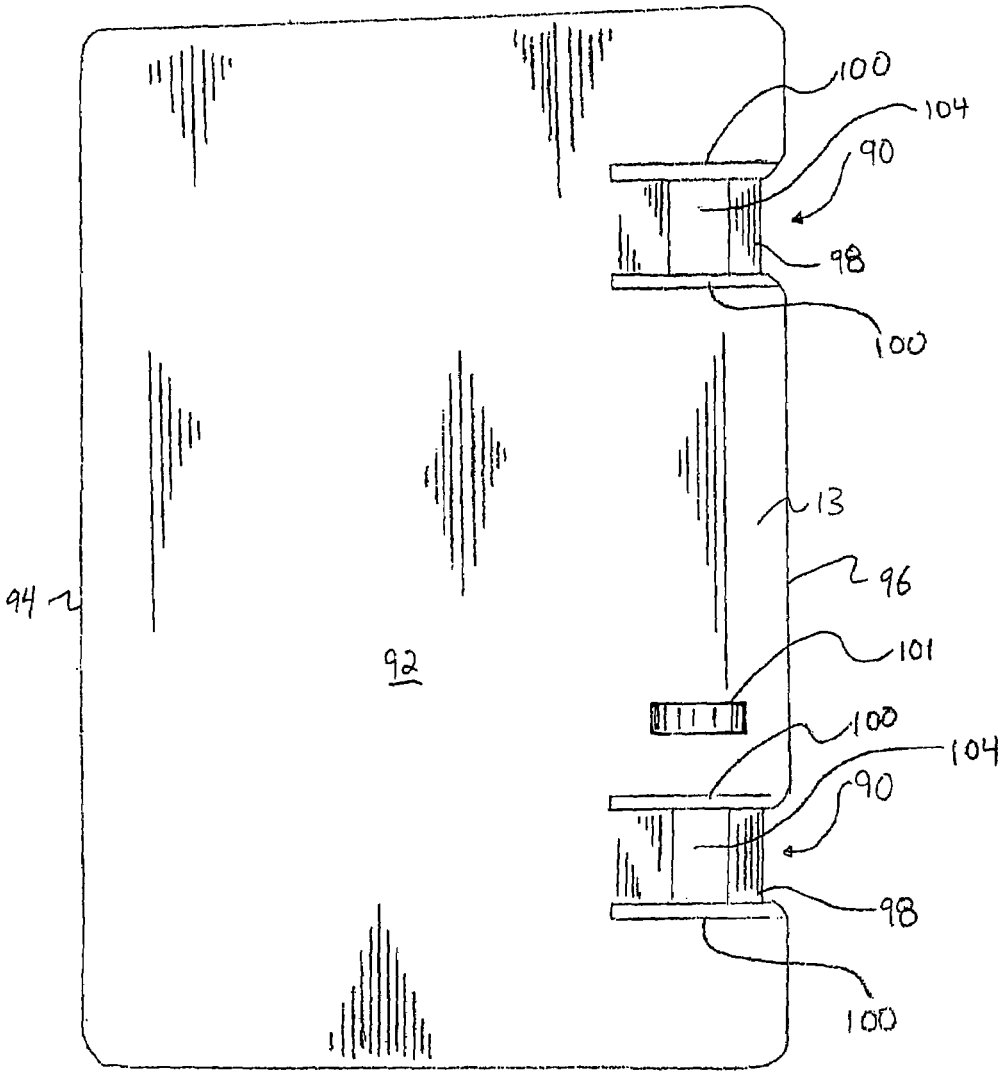
Figure 6:
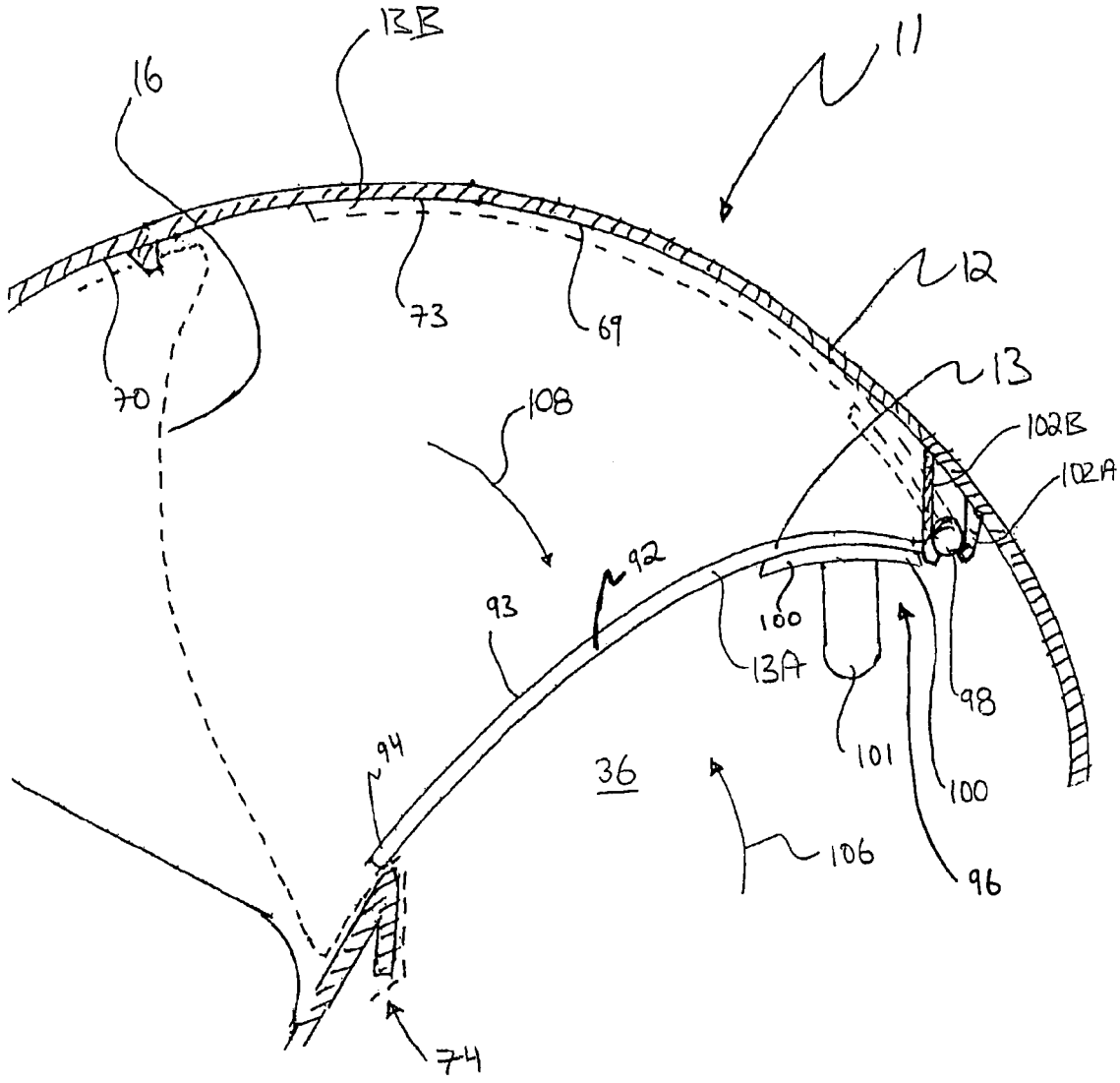
FIG. 6 is a partial cross-sectional view of the FIG. 1 vent showing detail of the damper member.

As shown best in FIGS. 5A and 5B, the interior surface of damper member 13 may comprise a tab 101 which facilitates the removal of damper member 13 from cover member 12. To remove damper member 13 from cover member 12, a person may extend their hand through an interior end 31 of vent passageway 36 to reach tab 101 and may pull tab 101 (and damper member 13) inwardly to dislodge dowels 98 from dowel enclosure members 102A, 102B. Damper member 13 may then be withdrawn through vent passageway 36.

Figure 7:
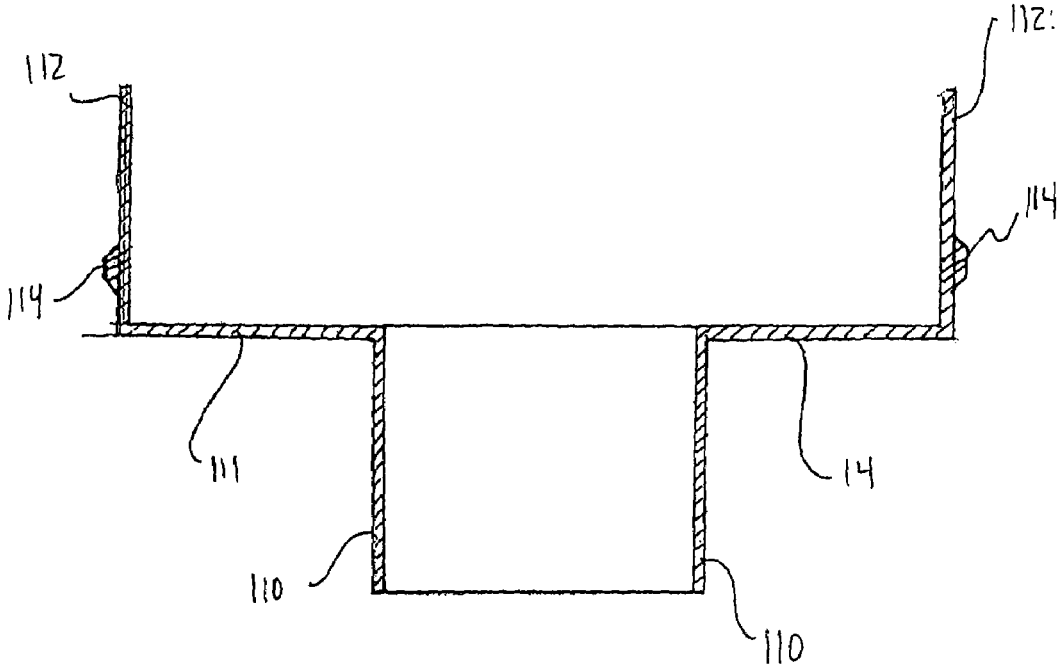
FIG. 7 is a cross-sectional view of the adapter member of the FIG. 1 vent.
Figure 8:
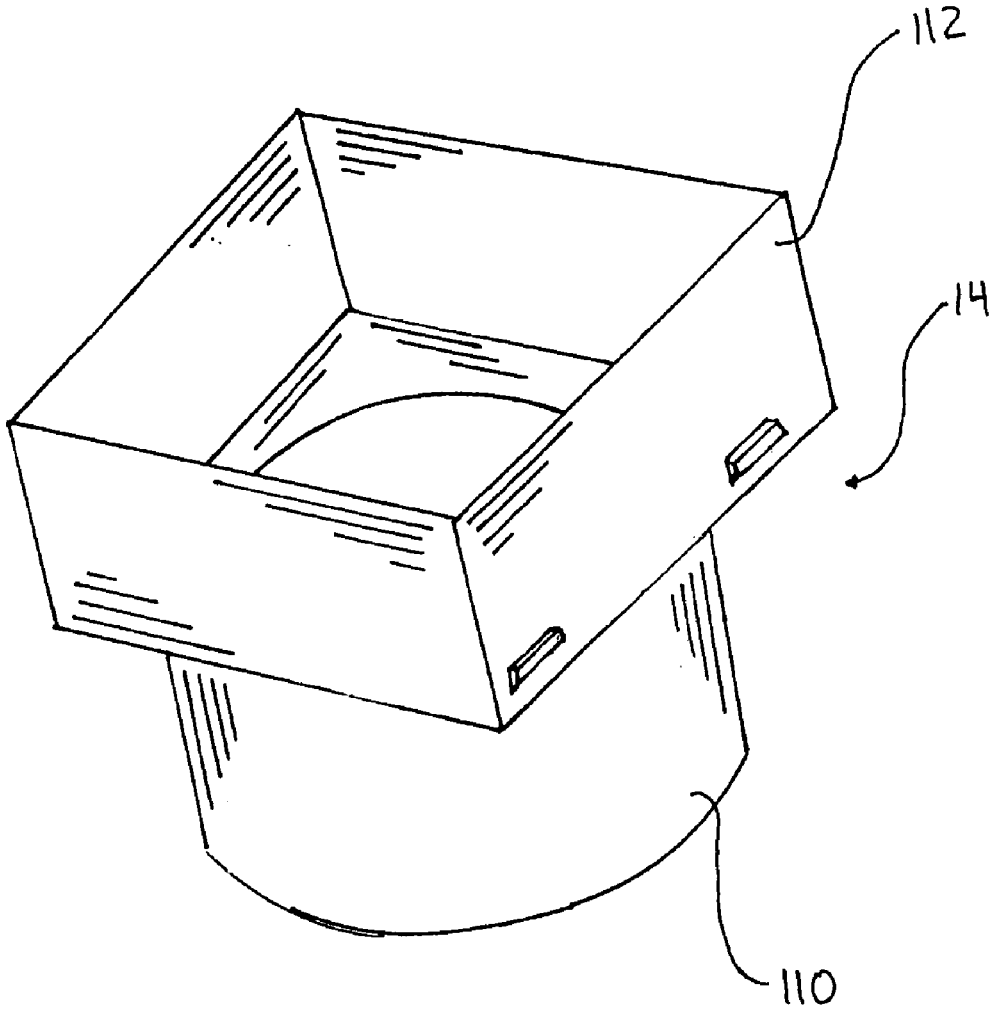
FIG. 8 is an isometric view of the adapter member of the FIG. 1 vent.

As shown in FIG. 2, vent 11 may comprise an adapter member 14 which couples cover member 12 to conduit 30. Adapter member 14 is shown in more detail in FIGS. 7 and 8. Adapter member 14 comprises a substantially hollow body 111. Body 111 of adapter member 14 also comprises a vent flange 112, which may be coupled to cover member 12, and a building flange 110, which may be coupled to conduit 30. When coupled between cover member 12 and conduit 30, adapter member 14 provides fluid communication between vent passageway 36 and conduit 30.

In the illustrated embodiment of FIG. 2, conduit 30 comprises walls 28A, 28B. Building flange 110 of adapter member 14 is sized and shaped to conform with walls 28A, 28B of conduit 30. In the illustrated embodiment, building flange 110 fits into walls 28A, 28B of conduit 30. In alternative embodiments, walls 28A, 28B of conduit 30 fit into building flange 110. In the illustrated embodiment (see FIGS. 1 and 8), building flange 110 is circular in cross-section. Those skilled in the art will appreciate that this circular shape merely represents one among many possible shapes of building flanges 110. A particular size and/or shape of building flange 110 may be selected to conform with the size and/or shape of conduit 30. For example, building flange 110 may be square or rectangular in cross-section.

In some embodiments, building flange 110 is attached to conduit 30 using fasteners (not shown) which project through building flange 110 and walls 28A, 28B of conduit 30. Such fasteners may include screws, nails, rivets, staples or the like. In other embodiments, building flange 110 is secured to walls 28A, 28B using a suitable adhesive or one or more tie-straps. In still other embodiments, building flange 110 is resiliently deformed for insertion into conduit 30 such that, when inserted, building flange 110 exerts a force against walls 28A, 28B to form a friction fit. Alternatively, conduit 30 may be resiliently deformed for insertion into building flange 110 such that, when inserted, conduit 30 exerts a force against building flange 110 to form a friction fit.

Figure 9:
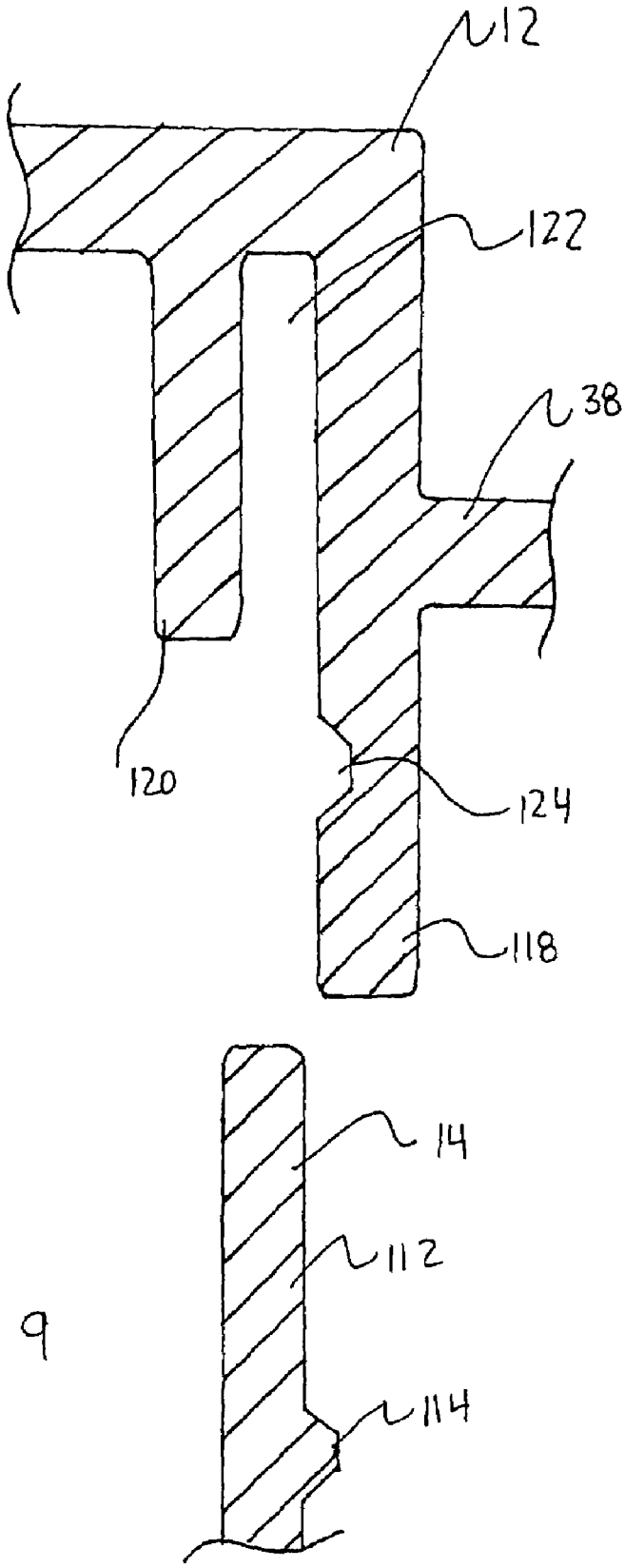
FIG. 9 is a partial exploded cross-sectional view depicting the attachment of the adapter member to the cover member of the FIG. 1 vent.

FIGS. 2 and 9 depict the attachment of adapter member 14 to cover member 12. Cover member 12 includes an adapter receiving rim 116 which comprises a pair of generally parallel flanges 118, 120. Flanges 118, 120 are spaced apart to form slot 122 therebetween. In one of its sidewalls, flange 120 comprises an indent 124 which opens into slot 122. Vent flange 112 of adapter member 14 comprises a projection 114 on a corresponding one of its sides. When cover member 12 is coupled to adapter member 14, vent flange 112 is inserted into slot 122, such that projection 114 fits into indent 124 of flange 120. Together, projection 114 and indent 124 function to secure cover member 12 to adapter member 14. Preferably, when vent flange 112 is inserted into slot 122, vent flange 112 resiliently deforms one or both of flanges 118, 120, such that flanges 118, 120 exert pressure on vent flange 112 which helps to secure cover member 12 to adapter member 14. Adapter member 14 may be removable from cover member 12 by similarly deforming one or both of flanges 118, 120 and withdrawing vent flange 112 from slot 122.

In the illustrated embodiment, vent flange 112 of adapter member 14 and adapter receiving rim 116 of cover member 12 are rectangular in cross-section. Those skilled in the art will appreciate that this rectangular shape represents one among many possible shapes for vent flange 112 and adapter receiving rim 116. For example, building flange 110 may alternatively be circular in cross-section.

As will be apparent to those skilled in the art in the light of the foregoing disclosure, many alterations and modifications are possible in the practice of this invention without departing from the spirit or scope thereof. For example:

- In the illustrated embodiment of FIG. 9, vent flange 112 is shown as having a single projection 114 on one of its sides and only flange 120 is shown as having a corresponding indent 124. In other embodiments, vent flange 112 may have a plurality of projections similar to projection 114 and flange 120 may comprise a corresponding plurality of indents. Vent flange 112 may have one or more projections on its other side and flange 118 may have one or more corresponding indents. In still other embodiments, vent flange 112 may have one or more indents and generally parallel flanges 118, 120 may comprise corresponding protrusions.
- In alternative embodiments, a suitable adhesive may be used to help secure adapter member 14 to cover member 12. A suitable adhesive may also be used in combination with adapter receiving rim 116 and vent flange 112 of the illustrated embodiment.
- In some embodiments, a suitable adhesive may be used to help secure screen 16 to cover member 12.
- FIG. 3B depicts a screen 16' having a third surface 66' that is substantially planar in its nominal state and FIG. 3A depicts a screen 16 having a third surface 66 with a single curve in its nominal state. Those skilled in the art will appreciate that screens according to the invention may incorporate third surfaces having a plurality of curves (i.e. one or more convex portions and one or more concave portions).

The above description and the claims set out below refer to gas flowing through vent 11. Those skilled in the art will appreciate that solid and liquid matter may also flow through vent 11. Typically, such solids and liquids will be suspended in a gas. Accordingly, the word "gas" should not be interpreted in a limiting sense.

In the illustrated embodiments, portions 70 and 73 of cover member surface 69 are separated from one another. In general, portions 70, 73 may overlap one another.

Accordingly, the scope of the invention is to be construed in accordance with the substance defined by the following claims.

What is claimed is:

1. A vent comprising:

a substantially hollow cover member having a cover member surface which defines a vent passageway, the cover member surface comprising a protrusion which projects into the vent passageway; and a screen comprising:

a plurality of screen apertures;

a first bend for receiving the protrusion;

a first surface which extends from the first bend along a first side of the protrusion and a second surface which extends from the first bend along a second side of the protrusion for gripping the protrusion between the first and second sides;

a third surface which extends from the second surface across the vent passageway to a first portion of the cover member surface on an opposing side of the vent passageway from the protrusion; and a fourth surface which extends from the third surface along the first portion of the cover member surface, wherein the first portion of the cover member surface comprises one or more projections which extend from the first portion of the cover member surface and project through one or more screen apertures in the fourth surface.

2. A vent according to claim 1 wherein the first bend has an interior angle in a range of 10–60°.

3. A vent according to claim 1 comprising one or more fastener members, each fastener member coupleable to a corresponding one of the one or more projections for retaining the fourth surface against the first portion of the cover member surface.

4. A vent according to claim 1 wherein the screen comprises a second bend between the second and third surfaces, the second bend having an interior angle in a range of 10–120°.

5. A vent according to claim 1 wherein the screen comprises a third bend between the third and fourth surfaces, the third bend having an interior angle in a range of 30–120°.

6. A vent according to claim 1 wherein the third surface is substantially planar prior to deformation of the screen.

7. A vent according to claim 1 wherein the third surface comprises at least one curve prior to deformation of the screen.

8. A vent according to claim 1 wherein the first surface comprises a distal end portion which extends beyond an edge of the first side of the protrusion and wherein the distal end portion is crimped.

9. A vent according to claim 1 wherein the screen comprises a Z-shaped bend on one end thereof, the Z-shaped bend including the first bend.

10. A vent according to claim 1 comprising a damper member located in the vent passageway and pivotally coupled to the cover member.

11. A vent according to claim 10 wherein an exterior surface of the damper member has a profile that is substantially similar to a contour of a second portion of the cover member surface.

12. A vent according to claim 11 wherein the damper member is pivotable between a closed configuration where a distal end of the damper member abuts against the protrusion and an open-most configuration wherein the exterior surface of the damper member extends along the second portion of the cover member surface.

13. A vent according to claim 11 wherein the profile of the exterior surface of the damper member and the contour of the second portion of the cover member surface are curved.

14. A vent according to claim 11 wherein the profile of the exterior surface of the damper member and the contour of the second portion of the cover member surface both comprise a similarly shaped bend.

15. A vent according to claim 1 comprising a substantially hollow adapter member, the adapter member coupleable to the cover member at its exterior end and to a conduit at its interior end to provide fluid communication between the vent passageway and the conduit.

16. A vent comprising:

a substantially hollow cover member having a cover member surface which defines a vent passageway, the cover member surface comprising a protrusion which projects into the vent passageway; and a screen comprising a plurality of screen apertures and a first bend for receiving the protrusion, the first bend resiliently deformable to exert pressure on the protrusion and to secure the screen to the cover member such that the screen spans the vent passageway; and a substantially hollow adapter member, the adapter member coupleable to the cover member at its exterior end and to a conduit at its interior end to provide fluid communication between the vent passageway and the conduit;

wherein the cover member comprises a pair of substantially parallel flanges which define a slot and wherein the exterior end of the adapter member comprises a vent flange which is insertable into the slot for coupling the exterior end of the adapter member to the cover member.

17. A vent according to claim 16 wherein the vent flange comprises one or more projections and at least one of the substantially parallel flanges comprises one or more corresponding indents and wherein, when the vent flange is inserted in the slot, the one or more projections project into the one or more corresponding indents.

18. A vent according to claim 16 wherein at least one of the substantially parallel flanges comprises one or more projections and the vent flange comprises one or more corresponding indents and wherein, when the vent flange is inserted in the slot, the one or more projections project into the one or more corresponding indents.

19. A vent according to claim 16 wherein when the vent flange is inserted in the slot, at least one of the substantially parallel flanges is resiliently deformed so as to exert pressure on the vent flange.

20. A vent comprising:

a substantially hollow cover member having a cover member surface which defines a vent passageway, the cover member surface having a first portion with a curved contour; and a damper member located in the vent passageway and pivotally coupled at one of its ends to the cover member, an exterior surface of the damper member having a curved profile that is substantially similar to the curved contour of the first portion of the cover member surface, the damper member pivotable to an open-most position wherein the curved profile of the exterior surface of the damper member extends along the curved contour of the first portion of the cover member.

21. A vent according to claim 20 wherein the cover member surface comprises a protrusion and wherein the damper member is pivotable to a closed configuration where a distal end of the damper member abuts against the protrusion.

22. A vent according to claim 21 comprising a screen comprising a plurality of screen apertures, the screen mountable to the cover member to span the vent passageway.

23. A vent according to claim 22 wherein the screen comprises a first bend for receiving the protrusion, the first bend resiliently deformable to exert pressure on the protrusion to secure the screen to the cover member.

24. A vent according to claim 23 wherein the screen comprises:

a first surface which extends from the first bend along a first side of the protrusion; and a second surface which extends from the first bend along a second side of the protrusion;

wherein the first and second surfaces exert pressure on the protrusion.

25. A vent according to claim 24 wherein the first bend has an interior angle in a range of 10–60°.

26. A vent according to claim 24 wherein the screen comprises:

a third surface which extends from the second surface across the vent passageway to a second portion of the cover member surface on an opposing side of the vent passageway from the protrusion; and a fourth surface which extends from the third surface along the second portion of the cover member surface.

27. A vent according to claim 26 wherein the second portion of the cover member surface comprises one or more projections which extend from the second portion of the cover member surface and project through one or more screen apertures in the fourth surface.

28. A vent according to claim 27 comprising one or more fastener members, each fastener member coupleable to a corresponding one of the one or more projections for retaining the fourth surface against the second portion of the cover member surface.

29. A vent according to claim 26 wherein the screen comprises a second bend between the second and third surfaces, the second bend having an interior angle in a range of 10–120°.

30. A vent according to claim 26 wherein the screen comprises a third bend between the third and fourth surfaces, the third bend having an interior angle in a range of 30–120°.

31. A vent according to claim 26 wherein the third surface is substantially planar prior to deformation of the screen.

32. A vent according to claim 26 wherein the third surface comprises at least one curve prior to deformation of the screen.

33. A vent according to claim 20 comprising a substantially hollow adapter member coupleable to the cover member at its exterior end and to a conduit at its interior end to provide fluid communication between the vent passageway and the conduit.

34. A vent comprising:

a substantially hollow cover member having a cover member surface which defines a vent passageway, the cover member surface having a first portion with a curved contour;

a damper member located in the vent passageway and pivotally coupled to the cover member, an exterior surface of the damper member having a curved profile that is substantially similar to the curved contour of the first portion of the cover member surface; and a substantially hollow adapter member coupleable to the cover member at its exterior end and to a conduit at its interior end to provide fluid communication between the vent passageway and the conduit;

wherein the cover member comprises a pair of substantially parallel flanges which define a slot and wherein the exterior end of the adapter member comprises a vent flange which is insertable into the slot for coupling the exterior end of the adapter member to the cover member.

35. A vent according to claim 34 wherein when the vent flange is inserted in the slot, at least one of the substantially parallel flanges is resiliently deformed so as to exert pressure on the vent flange.

36. A vent comprising:

a substantially hollow cover member having a cover member surface which defines a vent passageway, the cover member surface having a first portion that comprises a first bend; and a damper member located in the vent passageway and pivotally coupled at one of its ends to the cover member, an exterior surface of the damper member having a second bend, the second bend having a profile that is substantially similar to a contour of the first bend, the damper member pivotable to an open-most position wherein the profile of the second bend of the exterior surface of the damper member extends along the contour of the first bend of the first portion of the cover member.

37. A vent comprising:

a substantially hollow cover member having a cover member surface which defines a vent passageway;

a screen having a plurality of screen apertures, the screen mountable to the cover member to span the vent passageway;

a damper member pivotally mounted in the vent passageway;

a substantially hollow adapter member, the adapter member coupleable to the cover member at its exterior end and to a conduit at its interior end to provide fluid communication between the vent passageway and the conduit;

wherein the cover member comprises a pair of substantially parallel flanges which define a slot and wherein the exterior end of the adapter member comprises a vent flange which is insertable into the slot for coupling the exterior end of the adapter member to the cover member.

* * * * *